United States Patent [19]

Fuchs

[11] 4,328,046

[45] May 4, 1982

[54] CHROMATE CONVERSION COATINGS

[75] Inventor: Harold E. Fuchs, Kansas City, Mo.

[73] Assignee: Western Electric Co., Inc., New York, N.Y.

[21] Appl. No.: 197,051

[22] Filed: Oct. 14, 1980

[51] Int. Cl.[3] ..... C23F 7/26

[52] U.S. Cl. ..... 148/6.2

[58] Field of Search ..... 148/6.21, 6.2

[56] References Cited

U.S. PATENT DOCUMENTS

| | | | |
|---|---|---|---|
| 2,288,007 | 6/1942 | Lum | 148/6.21 |
| 2,548,419 | 4/1951 | Chester | 148/6.21 |
| 2,548,420 | 4/1951 | Chester | 148/6.21 |
| 2,634,224 | 4/1953 | Faucher | 148/6.16 |
| 2,793,967 | 5/1957 | Jeremias | 148/6.2 |
| 2,977,259 | 3/1961 | Schmelzer | 148/6.2 |
| 3,411,958 | 11/1968 | Sink et al. | 148/6.2 |
| 3,437,574 | 4/1969 | Sano et al. | 204/181 |
| 3,501,352 | 3/1970 | Shah | 148/6.2 |
| 3,553,034 | 1/1971 | Harvey et al. | 148/6.2 |
| 3,720,547 | 3/1973 | Melotik | 148/6.2 |
| 3,816,142 | 6/1974 | Lindeman | 148/6.2 |
| 3,849,141 | 11/1974 | Palm et al. | 148/6.2 |
| 4,123,290 | 10/1978 | Kennedy | 148/6.2 |

OTHER PUBLICATIONS

Lowenheim, Mod. Electroplating 2nd Ed. (1963), pp. 622, 623.

Lowenheim, Electroplating, p. 444.

Eppensteiner et al, Metal Finishing Guide Book, 2nd Directory 44th Ed., 1976, pp. 525, 541.

*Primary Examiner*—Ralph S. Kendall

*Attorney, Agent, or Firm*—W. O. Schellin

[57] ABSTRACT

A chromate conversion coating formed on an article in an acidic chromating bath in reaction with a metal surface on the article, such as cadmium or zinc, is stabilized by subjecting the coating to an alkaline bath having a pH in a range between 11 and 12, immediately upon removing the article from the chromating bath and without first rinsing the article in water. The stabilized coating exhibits resistance to damage during rinsing and drying operations.

13 Claims, 2 Drawing Figures

FIG.-1
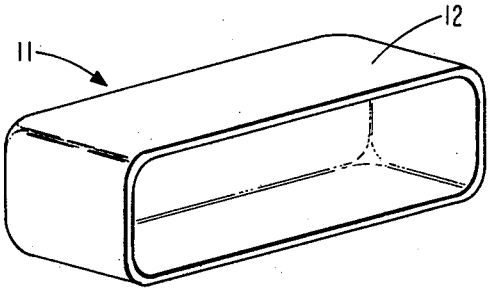
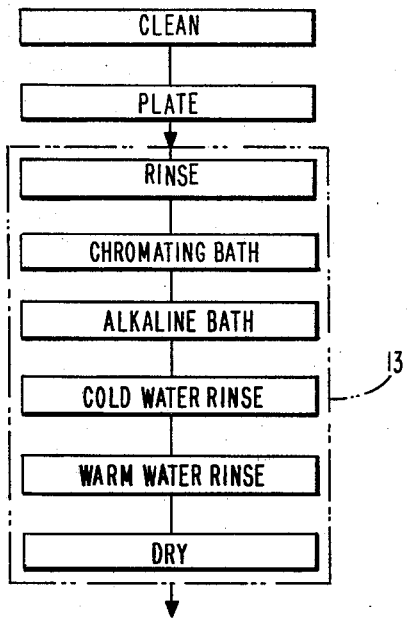
FIG.-2

CHROMATE CONVERSION COATINGS

TECHNICAL FIELD

This invention relates to chromate conversion coated articles and to methods of forming coatings on such articles. More particularly, the invention relates to articles having peel resistant chromate conversion coatings and to methods of minimizing the tendency of newly formed chromate conversion coatings to peel.

BACKGROUND OF THE INVENTION

Chromate conversion coatings are superficial layers which are formed at the surface of a base material, such as zinc or cadmium, to shield the base material or metal from corrosive interaction with the environment. For instance, it is well known that zinc or zinc plated surfaces develop a white, powdery corrosion product which is referred to as "white rust." The formation of such corrosion product is effectively inhibited by chromate conversion coatings.

Chromate conversion coatings are formed, for example, on zinc or zinc plated surfaces in a chemical reaction of the surface metal with a chromating solution. The chromating solution typically contains chromic acid and chromates or dichromates and may contain nitric and sulfuric acids, wetting agents and other additives. A number of chromating baths are commercially available, and as it is true for most proprietary processing baths, the precise analysis of such baths is typically not available. While chromating bath constituents may be purchased as soluble solids, a liquid bath concentrate is preferred. In preparing the bath, the concentrate is diluted with water to the desired concentration.

In the surface treatment of articles, such as relay cans of a draw quality, cold rolled steel, the articles are, for example, zinc plated to a preferred thickness of 0.005 mm. After typical rinsing in overflowing cold water and a brief drain period, the articles are immersed into a typical chromating bath. In forming the chromate conversion coating, a chemical reaction between the metal surface and hexavalent chromium in the chromating bath oxidizes the base metal, and the hexavalent chromium becomes trivalent. Compounds of the trivalent chromium precipitate at the oxidized metal surface as a gel, entrapping some of the hexavalent chromium from the solution.

According to known procedures, the chromated articles are rinsed in water and then dried. The rinsing steps may consist of a first, cold water rinse, followed by a second, warm water rinse, whereby the warm water temperature is preferably kept in the range of 50° C. The chromate conversion coatings are temperature sensitive and, in view of such a sensitivity, a hot water rinse would normally not be used. However, the chromate coatings are also initially soft with a low scratch resistance until the coatings have dried. Thus, a warm water rinse is a compromise to promote drying after rinsing without running the risk of damaging the newly formed coatings.

A problem occurs frequently in commercial chromating operations in that chromate coatings are rinsed off or become otherwise damaged during rinsing operations subsequent to the chromating step and prior to drying. The occurrence of such damage is of concern since the protection of the base metal is partially removed, and the appearance of the chromated surfaces becomes spotty. The apparent flaking of the chromate coatings have occurred in spite of careful handling of chromated parts during the rinsing steps.

In a chromating process, a high incidence of articles having such a flaked and spotty appearance causes rejections and tends to slow down and increase the cost of the chromating process. Consequently, a need exists to reduce or eliminate the occurrence of peeling or damage of the newly formed chromate coatings during the time between the removal of parts from the chromating bath until the coatings are dry.

SUMMARY OF THE INVENTION

The invention results in parts or articles which have chromated surfaces of a more uniform appearance, the chromate coatings of such articles having been stabilized in an alkaline bath having a pH in the range between 11 and 12.

In accordance with the invention, articles are subjected to a chromating bath to form chromate conversion coatings on surfaces of such articles. After forming such coatings, the articles are transferred to an alkaline stabilizing bath without intermediate rinsing of such articles. The stabilizing bath is a solution in water of a substance taken from the group of sodium hydroxide and potassium hydroxide, the bath having a pH in the range between 11 and 12.

BRIEF DESCRIPTION OF THE DRAWING

Advantages and features of the invention may be best understood from the following description when reference is made to the accompanying drawing wherein:

FIG. 1 is a pictorial representation of a typical article, the surface finish of which is improved by the invention; and FIG. 2 shows a flow diagram of significant steps of a process for chromating articles in accordance with the invention.

DETAILED DESCRIPTION

In reference to FIG. 1, there is shown a relay can or cover 11 as an example of an article to which the present invention is advantageously applied. However, it should be understood from the further description of the invention, that the particular shape or size of the article 11 is not of significance to the practice or to the usefulness of the invention.

The article 11 shown in FIG. 1 is a typical protective cover for mercury-wetted sealed contact switches. The particular article 11 is of a low carbon, draw quality, cold rolled steel, 0.4 mm thick and has nominal dimensions of $43.2 \times 13.5 \times 12$ mm. The particular size of the article 11 is primarily mentioned to describe the article as one which is typically processed in larger quantities, such as a typical lot size of 2500 to 4500, to maintain a low, single piecepart cost as compared to the cost of the described steps. However, the precise lot size is quite variable, since it depends primarily on the size of the container or barrel used in conjunction with the processing equipment.

The material of the article 11 is corrodible, and becomes protected against corrosion by a layer 12, wherein a surface metal, such as cadmium or zinc, has been reacted with by a chromating bath to form a passivated chromate conversion coating at the surface of the metal. The layer 12 is stabilized in accordance with a process described below in reference to FIG. 2. The stabilized layer 12 is found to resist peeling of the chromate coating during rinsing operations. Furthermore, the chromate coating appears to be more resistant to abrasion after the coating has become dry.

Referring now to FIG. 2, the articles 11 are cleaned and plated to form a metal layer as a basis for the layer 12. For example, in preparation for electroplating a zinc layer to an approximate thickness of 5 microns ($5\times10^{-6}$ meters) in a cyanide free, alkaline zinc bath, the articles 11 may be subjected to a sequence of several cleaning steps.

In a preferred method the articles are cleaned in an alkaline bath, rinsed in water, etch-cleaned in a hydrochloric acid solution, rinsed in water, desmutted in a caustic solution and then again rinsed in water. These cleaning process steps may vary, however. Other steps may be added or substituted. Various other methods of effecting a clean base surface for zinc plating may be preferred. Zinc plating is preferably accomplished in a typical electroplating process, wherein the articles are tumbled in the presence of an alkaline zinc bath. However, other baths and processes may be used to form the metal layer.

Referring now to the steps highlighted by the numeral 13 in FIG. 2, the zinc-plated articles 11 are first rinsed in water and are then preferably transferred to baskets in preparation for an immersion into a chromating bath. The chromating bath is preferably one of a number of commercially available proprietary formulations which contain, in addition to chromic acid, surfactants to promote a more uniform reaction over the surface of the articles. The chromating bath is preferably used at room temperature. However, it should be understood that other, and particularly higher, temperatures may be used to effect the chromating reaction.

The immersion time may be varied to compensate for variations in reaction time due to the condition of the bath. For example, as the bath ages the immersion time of the articles may progressively be lengthened to establish a uniform coating thickness on all of the articles 11 treated in the bath.

The thickness of the coating is indicated by its color. A light color generally indicates a thin layer whereas a dark color such as olive drab indicates a relatively thicker layer. However, a difference in composition between two chromating baths may also result in coatings of different color even though the thicknesses of the coatings are equal. Thus, only the coating colors of the same bath should be compared as thickness references.

In contrast to prior art procedures, the articles 11, upon being removed from the chromating bath, are no longer subjected to a rinsing dip. Instead, upon being removed from the chromating bath and being merely turned or tumbled to drain off excess chromating solution, the articles are directly dipped into an alkaline bath having a pH value in a range bounded by and including the values of 11 and 12. It should be noted, however, that tumbling the articles is only necessary because of the container shape of the articles. Thus, if the articles 11 were solid instead, and incapable of capturing and retaining any of the chromating solution, such tumbling action would be unnecessary. The articles are turned or tumbled with care to prevent the articles from scraping against each other unnecessarily.

The articles are retained in the alkaline bath for approximately three seconds. The bath is preferably agitated to adequately expose all chromated surfaces of the articles to the solution of the bath.

The solution of the alkaline bath is preferably a sodium hydroxide solution in ordinary water. The pH of the bath is adjusted to a preferred value of 11.5. At a pH of below 11, no particular advantage was seen, in that a considerable number of the articles exhibited a marred and flaked off appearance of the chromate conversion coatings after the completion of all rinsing and drying steps. When the pH of the solution was adjusted to a value above 12, a dipping of the articles for approximately three seconds resulted in some bleaching of the coatings. The desired color of the coated articles 11 is an iridescent yellow with some red and blue shadings. The bleached colors are known to indicate a thinning of the coatings below a desired thickness and an accompanying reduction of the protective properties of the coatings.

However, with the alkaline bath being maintained in a range of the pH between 11 and 12, dipping the articles into the bath for a time between 2–5 seconds directly after chromating and without an intermediate rinsing step, results in a wet state of the chromate conversion coating, having a uniform coating appearance with substantial reduction in a tendency to peel or rinse off in comparison to a wet state chromate conversion coating which has not been exposed to an alkaline solution. The term "wet state" applies to the coating immediately after being removed from the chromating bath and prior to being dried. Occasional scrape marks, apparently the result of handling a great number of the articles simultaneously may, however, still occur.

Following the alkaline dip, the articles 11 are rinsed and dried. Rinsing is preferred as a sequence of first a cold water rinse which is followed by a warm water rinse. The warm water has a preferred temperature of about 50° C. Chromate coatings can be destroyed by hot temperatures. A rinsing temperature in the range of 50° C. and no higher than 70° C. does not affect the newly formed coat. The second, warm water rinse promotes subsequent drying. The coatings on the articles are subsequently air dried. Again, care must be exercized not to expose the coatings to high temperatures during the drying process.

In contrast to prior art processes, dipping the chromated articles into an alkaline bath immediately after the chromating step without intermediate rinsing of the articles has effectively eliminated the tendency of the chromate coatings to peel or spot. Such peeling and spotting appeared to occur during the rinsing operations which in the prior art had typically followed the chromating step. It is believed that the alkaline dip fixes or stabilizes the chromate coatings and immediately increases their adhesion and the resistance to abrasion even prior to the rinsing and drying operations. Thus, any typical amounts of agitation during the rinsing operation is incapable of removing portions of the newly formed chromate coatings.

Substantially identical results of increased durability and adhesion of the chromate coatings were obtained from dipping the articles 11 into an alkaline bath directly after chromating, wherein the bath consisted of a solution of potassium hydroxide in water instead of a solution of sodium hydroxide in water. As in the example of the sodium hydroxide solution, the potassium hydroxide solution was diluted with water to adjust the pH of the bath to a value ranging between and including the values of 11 and 12. A preferred pH range in both examples is a pH value between 11.3 and 11.7. Adjustments are preferably made to the bath as soon as the pH value is determined to have deviated from such preferred range.

The temperatures of both the potassium hydroxide bath and the sodium hydroxide bath were kept in a range between and including 15° C. and 25° C. It appears that at the higher temperatures the stabilizing action of the bath proceeds faster and an immersion time at the lower end of a preferred range from 2 to 5 seconds for both the potassium hydroxide and the sodium hydroxide baths. As a practical matter the sodium hydroxide bath is preferred since the cost of the sodium hydroxide is less than that of the potassium hydroxide.

It should be apparent from the above description that changes and modifications can be made to various details of the described process conditions and also to the articles, as for example, to their shapes or to the composition of their innermost materials, without departing from the spirit and scope of the invention.

What is claimed is:

1. A method of forming a chromate conversion coating on the surface of an article having a surface of a metal taken from the group of cadmium and zinc, which comprises:

reacting the metal basis with an acidic chromating bath to form a chromate conversion coating over the metal basis; and without intermediate rinsing in water, immersing the formed coating in an alkaline solution at a temperature in the range between 15° C. and including 25° C. and having a pH value in a range bounded by and including the values of 11 and 12, such solution being water rinsable without leaving a noticeable color change on the formed chromate conversion coating.

2. A method of forming a chromate conversion coating on the surface of an article in accordance with claim 1, wherein immersing the coating in an alkaline solution comprises immersing the article into an alkaline bath of a solution in water of a compound taken from the group of potassium hydroxide and sodium hydroxide.

3. A method of forming a chromate conversion coating on the surface of an article in accordance with claim 2, which comprises removing excess chromating solution from the coating prior to immersing.

4. A method of forming a chromate conversion coating in accordance with claim 3, wherein the article is immersed into the bath to expose the coating for a period from two to five seconds.

5. A method according to claim 4, wherein the pH of the bath has a value in a range bounded by and including the values of 11.3 and 11.7.

6. A method according to claim 5, wherein the alkaline bath is a solution of sodium hydroxide in water.

7. A method according to claim 5, wherein the alkaline bath is a solution of potassium hydroxide in water.

8. A method of passivating a zinc plated surface which comprises:

exposing the surface to an acidic chromating solution to form a chromate conversion coating on such surface;

removing the surface from exposure to nonadherent excess of the chromating solution; and immersing the surface in an alkaline stabilizing solution at a temperature in the range between and including 15° C. and 25° C. without an intermediate rinsing of the surface after removing the surface, such stabilizing solution having a pH value in a range bounded by and including the values of 11 and 12, such stabilizing solution being removable after such immersion in a water-rinse without imparting a change in color to the formed chromate conversion coating.

9. A method according to claim 8, wherein the stabilizing solution is at room temperature and the time of immersion in the solution ranges between the included intervals of 2 and 5 seconds.

10. A method according to claim 9, wherein the stabilizing solution is an aqueous solution of a compound from the group of potassium hydroxide and sodium hydroxide.

11. A method according to claim 10, wherein the pH of the stabilizing solution ranges between the included values of 11.3 and 11.8.

12. A method according to claim 11, wherein the immersion of the surface in the stabilizing solution is followed by rinsing the surface in water.

13. A method according to claim 12, wherein rinsing comprises rinsing the surface in cold water having a temperature in the range between 10° C. and 25° C. followed by rinsing the surface in warm water having a temperature in the range between 40° C. and 60° C.

* * * * *